United States Patent [19]

Gabbay et al.

[11] Patent Number: 4,780,901

[45] Date of Patent: Oct. 25, 1988

[54] DEVICE FOR THE COOLING OF AN X-RAY SOURCE

[75] Inventors: Emile Gabbay; Jacques Le Guen, both of Paris, France

[73] Assignee: Thomson CGR, Paris, France

[21] Appl. No.: 113,487

[22] Filed: Oct. 28, 1987

[30] Foreign Application Priority Data

Oct. 28, 1986 [FR] France ..... 86 14978

[51] Int. Cl.[4] ..... H01J 35/10

[52] U.S. Cl. ..... 378/141; 378/130; 378/200; 165/104.33; 165/104.11

[58] Field of Search ..... 378/127, 130, 141, 142, 378/200, 199; 165/104.33, 104.11 A

[56] References Cited

U.S. PATENT DOCUMENTS

| | | | |
|---|---|---|---|
| 1,656,826 | 1/1928 | Morrison | 378/200 |
| 1,874,478 | 8/1932 | Fayer | 378/142 |
| 1,992,335 | 2/1935 | Tietig | 378/141 |
| 3,959,685 | 5/1976 | Konieczynski . | |
| 4,300,622 | 11/1981 | Lindner | 165/104.11 A |
| 4,734,927 | 3/1988 | Leguen et al. | 378/141 |

FOREIGN PATENT DOCUMENTS

| | | | |
|---|---|---|---|
| 3220212 | 12/1983 | Fed. Rep. of Germany | 378/141 |
| 0023866 | 2/1981 | France . | |
| 58-198899 | 11/1983 | Japan . | |

*Primary Examiner*—Carolyn E. Fields
*Assistant Examiner*—Joseph A. Hynds
*Attorney, Agent, or Firm*—Oblon, Fisher, Spivak, McClelland & Maier

[57] ABSTRACT

A device is disclosed for the cooling of an X-ray tube contained in a casing, using a fluid put into forced circulation in a cooling circuit comprising a heat exchanger. The device of the invention can be used to obtain efficient cooling while, at the same time, using a small volume of fluid and a heat exchanger of smaller size than in the prior art. To this end, the cooling circuit comprises means to, firstly, store a quantity of heat accumulated by the fluid when the latter reaches a predetermined temperature during an examination period and, secondly, to restore this quantity of heat during an idle period which follows the examination period.

10 Claims, 1 Drawing Sheet

PUMP
FIRST HEAT EXCHANGER

θ
θm
θf
θ1
θ°
T
t0
t1
t2
t3
t4
T1
T2
T3
T4

DEVICE FOR THE COOLING OF AN X-RAY SOURCE

BACKGROUND OF THE INVENTION

1. Field of the Invention

The invention pertains to a device for the cooling of an X-ray source of the type where an X-ray tube is cooled by means of a fluid put into forced circulation.

2. Description of the Prior Art

An X-ray source comprises an X-ray tube contained in a fitted-up casing. The casing acts as a shield with respect to X-rays, and electrical and mechanical shocks. It is becoming increasingly frequent for the X-ray source to comprise also a system to cool the X-ray tube and the casing. This cooling is necessary because the electrical energy used to produce X-rays is converted into X-radiation with an efficiency of about 1%, i.e. 99% of this energy is converted into heat inside the source.

In X-ray applications entailing a very small work load, i.e. where the rate at which shots are taken is slow and corresponds to a mean power dissipation of about 200 Watts, natural convection phenomena are enough to do the cooling. A small fan near the casing further increases convection around the said casing so that the mean power dissipation reaches about 400 watts.

With modern X-ray diagnosis methods using, for example, vascular examination, X-ray cinematography or scanners, the shots are taken at a very fast rate and may entail a mean power dissipation of several thousands of watts. For X-ray applications of this type, the cooling systems are far more complex and bigger, and the operation and performance of these x-ray diagnosis installations, where the thermal load of the X-ray source is very high, is conditional upon the efficiency of these cooling systems.

The most widespread cooling method used, when the thermal load is high, consists in cooling the X-ray tube by using a fluid already contained in the casing in order to provide electrical insulation. This fluid may be oil for example. The fluid or oil is put into forced circulation around the X-ray tube and, outside the casing, where it flows into a cooling circuit comprising a heat exchanger. The fluid or oil, having received the heat produced by the X-ray tube, is cooled in turn when it flows into the heat exchanger. The heat exchanger may be, for example, of the oil-air exchanger type or again, of the type comprising a second circuit in which there flows a second cooling fluid such as water, for example.

Thus the X-ray tube and the casing are cooled by the oil which flows through the casing, the oil itself being cooled by means of the heat exchanger, the dimensions of which should make it possible to remove the heat produced by the power dissipated during an operating cycle of the X-ray source.

In radiology, and especially in scanner applications, an operating cycle consists of two consecutive periods. The first of these periods corresponds to the intensive operation of the X-ray source and is called the examination period. The second period is called the idle period and corresponds to a stoppage in the operation of the X-ray source. With scanners, the examination of a patient calls for a great many sectional views, one after another, so that during the examination period the heat load is extremely high. Then, between two examinations of patients, i.e. during the idle period, no heating is given to the X-ray source. Because of this, the heat exchangers used in the prior art are over-sized with respect to the power dissipated during an operating cycle. Consequently, these heat exchangers have certain disadvantages, in addition to being to their high cost ad excessive bulk and weight which entail the use of heavy complicated mechanical means to make the casing movable.

With this method the oil, in flowing through the casing, receives a quantity of heat Q during the examination period. This heat Q is divided into two parts Q1 and Q2. The first part Q1 is removed by the heat exchanger during the examination period. The second part Q2 raises the temperature of the casing/cooling circuit unit by a value $\theta$ such that:

$$\theta=(Q2/\mu), \tag{1}$$

where $\mu$ is the equivalent thermal capacity of the unit.

It mst be noted that, in the prior art, the method used to avoid having heat exchangers of absolutely unacceptable dimensions is to increase the thermal capacity $\mu$ of the unit formed by the casing and the cooling circuit, by increasing the volume of fluid or oil used to cool the casing and the X-ray tube. This method, apart from increasing the volume and weight of the said unit, has the disadvantage of reducing the efficiency of the heat exchanger.

For, if we assume, for example, that the heat exchanger is of the oil/outer air type, the quantity of heat that the said heat exchanger can be used to dissipate is proportionate, according to an initial estimate, to the difference in temperature between the fluid or oil flowing through the heat exchanger and the outer air.

Furthermore, the rise in the temperature of the unit from a starting temperature $\theta 1$ up to a maximum permissible temperature of $\theta m$ is written:

$$\theta m - \theta 1 = \frac{Pe}{\alpha}\left(1 - e^{\frac{-\alpha T1}{\mu}}\right),; \tag{2}$$

where Pe is the mean power during an examination, T1 is the period corresponding to the examination, $\alpha$ is the exchange coefficient of the heat exchanger and $\mu$ is the thermal capacity of the unit. It follows from the first relationship (1) above that the exchange coefficient $\alpha$ should be as great as possible to limit the rise in temperature of the unit, the said coefficient $\alpha$ being limited, firstly, by the size of the heat exchanger and, secondly, by the maximimum permissible temperature of the unit.

It can also be seen from the second relationsup (2) above that the greater the thermal capacity $\mu$, the slower is the rise in temperature. Thus, in the prior art, the increase brought about in the thermal capacity $\mu$ in order to limit the dimensions of the heat exchanger is such that the maximum permissible temperature is reached at the end of the examination period T1. As a result of this, it is only at the end of the examination period T1 that the exchange coefficient $\alpha$ is at its greatest. This leads to increasing the size of the exchanger so that a part of the advantage obtained by increasing the volume of oil is lost.

3. Summary of the Invention

The present invention pertains to a device for the cooling of an X-ray source which can be used to obtain the efficient cooling of the casing and the X-ray tube, using a small volume of fluid or oil to cool the casing and the X-ray tube while, at the same time, using a heat exchanger which is small when compared with heat exchangers used in the prior art. This result is obtained by a new arrangement of means which makes it possible, in particular, to store heat during the examination period and then to restore this heat to the heat exchanger between examination periods, so that the heat exchanger works as efficiently as possible at an almost continuous rate.

The invention pertains to a cooling device for an X-ray source comprising a casing containing an X-ray tube that works with a heat load which is higher during an examination period than during an idle period which follows the said examination period, the casing further containing a fluid to which the X-ray tube yields its heat, the fluid being put under forced circulation along a given direction in the casing and in a cooling circuit comprising a heat exchanger, the heat accumulated by the fluid comprising a first quantity of heat which is partially removed by the heat exchanger and a second quantity of heat which tends to raise the temperature of the casing/cooling circuit unit, wherein the cooling circuit comprises means which firstly store a third quantity of heat accumulated by the fluid when the said fluid reaches a pre-determined temperature and, secondly, to restore this third quantity of heat to the heat exchanger by means of the fluid during the idle period which follows the examination period.

BRIEF DESCRIPTION OF THE DRAWINGS

The invention will be better understood from the following description of a non-exhaustive example made with reference to the two appended figures, of which.

DETAILED DESCRIPTION OF THE INVENTION

Figure 1:
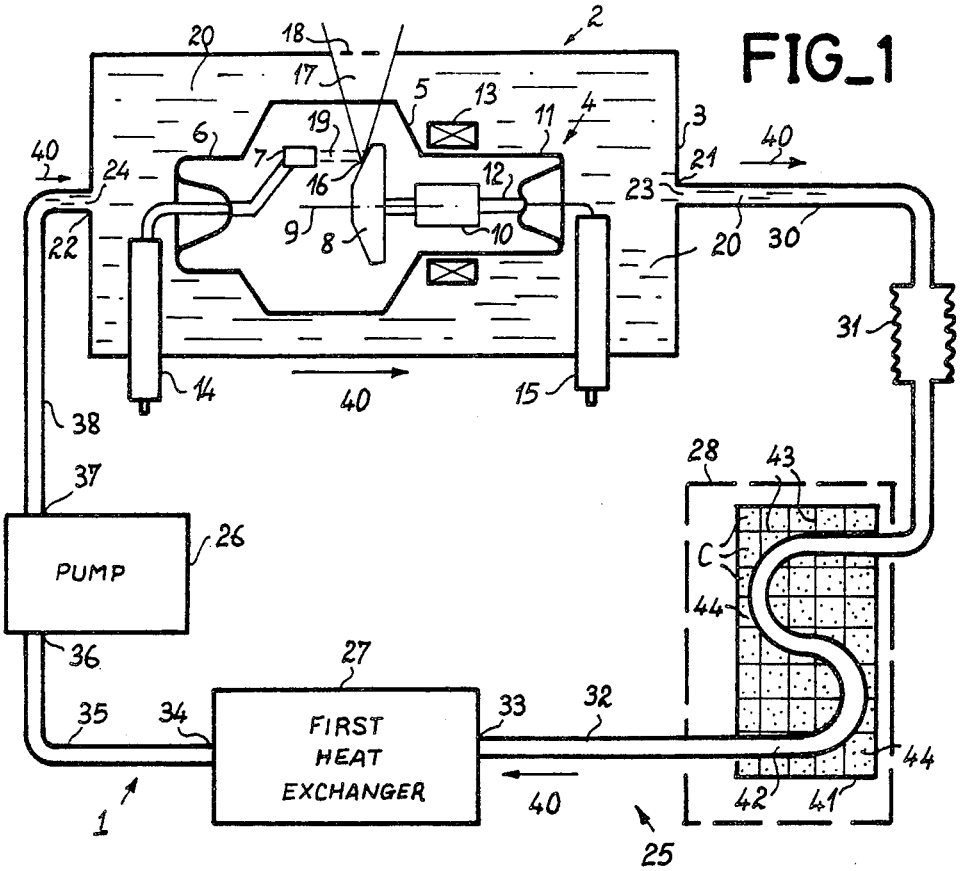
FIG. 1 gives a schematic view of a cooling device according to the invention.

FIG. 1 shows a cooling device 1 designed to cool an X-ray source 2. The X-ray source 2 comprises a casing 3 which conventionally contains an X-ray tube 4. The X-ray tube 4 is of a conventional type and has a vacuum-sealed shell 5. The first end 6 of the said shell 5 bears a cathode 7 set so that it faces an anode disk 8. In the non-exhaustive example described herein, the said anode disk consitutes a rotating anode. The anode disk 8 is joined, along its axis of symmetry 9, to a rotor 10 which is itself borne by the second 11 of the shell 5 by means of a supporting shaft 12. The rotation of the rotor 10 and the anode disk 8 around the axis of symmetry 9 is provided by a stator 13 set outside the shell 5. The cathode 7 and the anode 8 are electrically connected, respectively, on the first end 6 side and the second end 11 side of the shell 5, to a first high-voltage connector 14 and a second high-voltage connector 15 mounted conventionally on the casing 3 so as to come out of this casing without jeopardizing its imperviousness. The high-voltage connectors 14, 15 are designed to be connected, in a known way, to a electrical source or sources (not shown). Since the other electrical connections needed for the operation of the X-ray tube 4 are also known and since they do not participate in the invention, they are not shown in the figure.

When the X-ray tube 4 is in operation, the cathode 7 generates an electron beam 19 which bombards the anode 8 at a point where it forms a focus 16 fromwhich X-rays are emitted. These X-rays form a beam 17 which emerges from the casing 3 through an outlet window 18. The heat created in the anode 8 by the bombardment of the electron beam 19 is transferred conventionally to the shell 5, mainly by heat radiation from the anode 8. The casing 3 contains a fluid 20 in which the shell of the X-ray tube 4 bathes. the fluid 20 conventionally consists of oil, the first function of which is to provide electrical insultion in the casing 3. In the non-exhaustive example described, the second function of the said oil is to cool the said X-ray tube 4, the said fluid 20 or oil being hereinafter called oil in order to simplify the description. To this end, the casing 3 has a hole 23, 24 at each of its two opposite ends 21, 22. Through these holes, the casing 3 communicates with a cooling circuit 25 in which the oil 20 is put into forced circulation so that it is cooled outside the casing 3 after having received the heat produced by the X-ray tube 4.

The cooling circuit 25 comprises, firstly, a conventional type of pump 26 designed to force the flow of oil 20 and, secondly, a heat exchanger 28 which is of a conventional type in itself. In the non-exhaustive example described, heat exchanger 27 is of the oil/air type, i.e. the oil 20 which flows into the heat exchanger yields its heat to the surrounding air. The heat exchanger 27 may, for example, consist of a radiator comprising a coil (not shown) fitted with fins, and the oil 20 which flows into this coil yields heat to the surrounding air by convection. This convection may be promoted by a fan (not shown).

According to one characteristic of the invention, the cooling circuit further comprises means 28 to store the heat accumulated by the oil 20 before it flows through the heat exchanger 27.

The first hole 23 of the casing 2, located on the second end 11 side of the X-ray tube 4, namely on the anode 8 side, communicates with a tube 30 in which the oil 20 is conducted by the means 28 designed to store the heat. In the non-exhaustive example described, an expansion device 31 is set between the casing 23 and the means 28 designed to store heat. The expansion device 31 is used to compensate for the expansion of the oil 20 by modifying its volume. This expansion device 31 is of a type known per se. A second tube 32 connects the means 28, designed to store heat, to an input 33 of the heat exchanger 27, the output 34 of which is connected by a third tube 35 to the input 36 of the pump 26. An output 37 of the pump 26 is connected by a fourth tube 38 to the input of the casing 3, namely to the second hole 24 which is set on the cathode 7 side. The pump 26 gives the oil 20 a direction of flow, indicated in FIG. 1 by arrows 40, such that the oil 20, which enters the casing 3 through the second hole 24, flows through the casing 3 in the direction of the first hole 23 through which it emerges from the casing 3, then flows into the expansion device 31, then flows through the means 28 designed to store heat, then flows through the heat exchanger 27 and then through the pump 26 before returning to the casing 3.

The function of the heat-storing meanas 28 is to store the heat accumulated by the oil 20 in contact with the X-ray tube 4. But, according to another characteristic of the invention, this function is provided only from the moment when the temperature of the oil 20 has reached a pre-determined value, when the oil 20 flows through the means 28 to store the heat, i.e. the heat-storing means 28 play the same role, with respect to heat, as an inertial mass in a mechanical system, and the action of the said means 28 is controlled with a temperature threshold.

For this purpose, in the non-exhaustive example shown, the heat-storing means 28 comprise a second heat exchanger 41. The second heat exchanger 41 demarcates an enclosed volume in which a solid material C is melted under the effect of the heat yielded to the second heat exchanger 41 by th oil 20. The second heat exchanger 41 has a coil 42 through which flows the oil 20 to be cooled. The coil 42 has fins 43 which form partition walls. The crisscrossing of the said walls forms cells filled with the material C, which is symbolized by a cloud of dots in the figure.

The nature of the material C is chosen so that its melting point is close to the pre-determined temperature which, in the non-exhaustive example shown, corresponds to the maximum temperature desired for the oil 20 in the casing 3.

The material C is further chosen so that it has a latent heat of fusion which is high enough, at least 10 calories per gram for example, for it to be capable of storing a far greater amount of heat in a small volume. Thus, for example, if it is desired that the oil 20 should not exceed a temperature of 80° C. in the casing 3, a material C may comprise, for example, stearic acid which melts at 70° C. and has a latent heat of fusion of about 50 calories per gram. The melting of the material C further makes it possible to store a large quantity of heat during the examination period T1 when the X-ray tube 4 works with a high heat load and, secondly, it makes it possible to restore this heat to the first heat exchanger 27, namely the oil 20, during the idle period T2 when the X-ray tube 4 works with a reduced or zero heat load, owing to the fact that the material C resolidifies and restores the heat which it has accumulated during its melting.

In operation during the examination period T1, the heat produced by the X-ray tube 4 is yielded to the oil during the said period, and this heat is divided into two quantities Q1, Q2. The first quantity Q1 is removed by the first heat exchanger 27 during the examination period T1. The second quantity of heat Q2 raises the temperature of the unit formed by the casing 3 and the entire cooling circuit 25 for as long as the material C has not melted. When the material C melts, it absorbs calories depending on its latent heat of fusion, so that the temperature of the oil 20 at the input 33 of the first heat exchanger is substantially stabilized at the same temperature as the melting temperature of the material C. This gives a substantial reduction, as compared with the prior art, of the thermal capacity $\mu$ of the casing/cooling circuit unit 3–25 by reducing the volume of the oil 20 so that the maximum temperature $\theta m$ of the oil 20 in the casing 3 is quickly reached and so that the heat exchange at the first heat exchanger 27 takes place at a high temperature. The consequence of this is to increase the efficiency of the first heat exchanger 27, as compared with the prior art, thus making it possible to reduce the dimensions.

Figure 2:
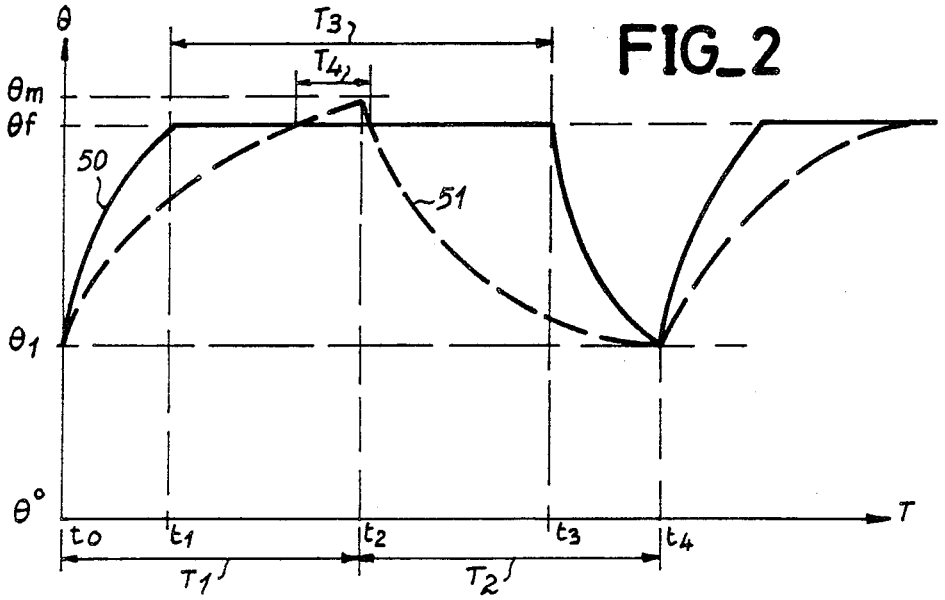
FIG. 2 is a graph which illustrates the functioning of the cooling device of the invention.

FIG. 2 illustrates this functioning by a graph in which a first curve 20 shows the variations in the temperature of the oil 20 at the input 33 of the first exchanger, as a function of the period T.

Assuming that the X-ray source 2 has already been heated and cooled, the temperature of the oil 20 at an instant to, when the examination period T1 begins under a high heat load, is a starting temperature $\theta l$ ranging between the temperature $\theta o$ of the ambient air and the maximum temperature $\theta m$ of the oil 20 in the casing 3. With the cooling device according to the invention, the temperature of the oil 20 increases from the instant to to a second instant t1 where it reaches the melting temperature $\theta f$. Since the melting of the material C has begun at the second instant t1, this melting absorbs a third quantity of heat Q3 which corresponds to the calories yielded by the X-ray tube 4 to the oil 20 when the said oil 20 reaches the maximum temperature $\theta m$. Consequently, the temperature of the oil 20 at the inlet to the first heat exchange 27 is kept appreciably constant at one and the same value as the melting temperature $\theta f$. The melting temperature $\theta f$ may be a few degrees C less than the maximum temperature $\theta m$ of the oil 20 in the casing 3.

The oil 20 retains a temperature which is close to the melting temperature $\theta f$ after the end, at a third instant t2 of the examination period T1. For, starting with the third instant t2, which also corresponds to the beginning of the idle period T2, the X-ray tube 4 no longer produces any heat, and the temperature of the oil 20 at the outlet of the casing 3 decreases. Subsequently, the material C tends to resolidify and to give back the oil 20 the heat stored by it during the examination time T1. The result of this is that the oil 20 at the inlet of the first heat exchanger 27 stays at substantially the same temperature as the melting temperature Of until a fourth instant t3 when the material C is entirely resolidified. Starting from this instant t4, the temperature of the oil 20 at the inlet of the first heat exchanger 27 diminishes until it reaches the starting temperature $\theta l$ at a fifth instant t4.

This makes it possible, during a third period T3, to make the first heat exchanger 27 work at a temperature close to the melting temperature $\theta f$ which is itself close to the maximum temperature $\theta m$ of the oil 20 in the casing 3. Consequently, the first heat exchanger 27 works at a high temperature, thus improving the exhange coefficient $\alpha$ during the third period T3 which may be greater than the examination period T1.

A second curve 51, drawn in broken lines in FIG. 2, illustrates the working of a cooling device according to the prior art. In the prior art, the oil which has received heat from an X-ray tube has to be cooled by a cooling device, for example, a device of the same type as the first heat exchanger 27. When the device is started up under a high heat load, starting from the instant to, the temperature of this oil increases from the starting temperature $\theta l$ until it reaches the maximum temperature $\theta m$ permissible in the casing at the third instant t2, and then decreases until it returns to the starting temperature $\theta l$. In this case, it is observed that, unlike the case of the invention, a temperature close to the maximum temperature $\theta m$ is preserved only during a fourth period T4 which is far smaller than the examination period T1. This means that a heat exchanger in an installation of the prior art has a poor exchange coefficient $\alpha$ during the examination period T1. As explained in the introduction, one method of coping with the poor exchange coefficient $\alpha$ in the prior art consists in increasing the volume of oil to increase the thermal capacity of the unit.

By contrast, with the present invention, owing to the means 28 used to store the heat accumulated in the oil 20, the equivalent thermal capacity $\alpha$ of the casing/cooling circuit unit 3-25 is far smaller than in the prior art. The result of this is, firstly, a major reduction in weight and bulk and, secondly, the fact that the maximum temperature $\theta m$ is reached much before the end of the examination period T1. This means that the sum of the second and third quantities of heat Q2+Q3 is greater than the product of the thermal capacity $\mu$ by the difference $\alpha\theta$ between the starting temperature $\theta l$ and the maximum temperature $\theta m$, namely:

$$\mu \cdot \Delta\theta < Q2 + Q3.$$

Another advantage provided by the invention lies in the fact that it is not necessary to wait for the oil 20 to return to the starting temperature $\theta l$ in order to begin another examination period T1, namely to put the X-ray tube 4 back into operation with a high heat load. By contrast, in the prior art, the oil has to be at the starting temperature in order to begin a new examination owing to the fact that the maximum temperature $\theta m$ would be reached more quickly and because the examination period would have to be shortened in order to avoid going beyond this maximum temperature $\theta m$.

Yet another advantage of the invention lies in the fact that, by maintaining an almost-constant temperature of the oil 20, the effects of thermal expansion are reduced to the minimum.

This description constitutes a non-exhaustive example which shows how a cooling device for an X-ray source, according to the invention, can be used to obtain cooling which is far more efficient and sure than in the prior art while, at the same time, giving a substantial reduction in the bulk and weight of the casing 3, the heat exchanger 27 and the oil 20.

The products which may be used as the material C are many and they are chosen according to the power dissipated during the examination period, the length of the examination period and the maximum power desired for the oil in the casing 3. Thus, for example, if it is accepted that the temperature of the oil 20 in the casing 3 can rise up to about 110° C., the material C may be methyl fumarate which has a density of 1.37 and a melting point of 102° C. with a latent heat of fusion of 60 calories per gram. If it is assumed that this material has a volume of seven liters, these seven liters could store about 2,353,000 Joules once a temperature of 102° C. is reached. One liter of oil can accumulate about 400 calories per degree and, for an increase in temperature from 50° C. to 100° C., one liter of oil can accumulate 20,000 calories, namely 84,000 Joules. Thus it is observed that, to store 2,350,000 Joules using oil, about twenty-seven additional liters of oil would have to be used, i.e. a volume which is about four times greater than that of the material C without however obtaining the effect of limiting the maximum temperature $\theta m$ or improving the exchange coefficient o of the first heat exchanger 27.

What is claimed is:

1. A cooling device for an X-ray source comprising a casing which contains a X-ray tube that works with a heat load which is higher during an examination period than during an idle period which follows the examination period, the casing further containing a fluid to which the X-ray tube yields its heat, the fluid being put under forced circulation along a given direction in the casing and in a cooling circuit comprising a first heat exchanger, the heat accumulated by the fluid during the examination period comprising a first quantity of heat which is partially removed by the first heat exchanger and a second quantity of heat which tends to raise the temperature of the casing/cooling circuit unit, wherein the cooling circuit comprises means which firstly store a third quantity of heat accumulated by the fluid when the fluid reaches a pre-determined temperature and, secondly, to restore this third quantity of heat to the first heat exchanger by means of the fluid during the idle period which follows the examination period.

2. A cooling device according to claim 1 wherein the means to store the third quantity of heat comprise a second heat exchanger in which the fluid flows and in which there is a solid material which melts, absorbing the third quantity of heat, through to its latent heat of fusion when the fluid appreciably reaches the melting temperature of the material.

3. A cooling device according to the claim 2 wherein the material that has melted during the examination period is resolidifed during the idle period, yielding the third quantity of heat to the first heat exchanger by means of the fluid.

4. A cooling device according to the claim 1 wherein the means used to store the heat are placed upstream of the first heat exchanger, according to the direction in which the fluid flows.

5. A cooling device according to the claim 1 wherein the unit formed by the casing, the cooling circuit and the fluid has a thermal capacity such that the product of the thermal capacity by a temperature difference between a starting temperature and the maximum temperature is smaller than the sum of the second and third quantities of heat.

6. A cooling device according to the claim 2 wherein the melting temperature of the material ranges between 50° C. and 120° C.

7. A cooling device according to the claim 2 wherein the material has a latent heat of fusion which is equal to or greater than 10 calories per gram.

8. A cooling device according to the claim 2 wherein the material is methyl fumarate.

9. A cooling device according to the claim 2 wherein the material is stearic acid.

10. A cooling device according to the claim 2 wherein the material is naphthalene.

* * * * *